US011505438B2

(12) United States Patent
Matsui

(10) Patent No.: US 11,505,438 B2
(45) Date of Patent: Nov. 22, 2022

(54) AUXILIARY CYLINDER APPARATUS, WORKING MACHINE INCLUDING SAME, AND USE OF AUXILIARY CYLINDER

(71) Applicant: KOBELCO CONSTRUCTION MACHINERY CO., LTD., Hiroshima (JP)

(72) Inventor: Dairo Matsui, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 38 days.

(21) Appl. No.: 17/302,929

(22) Filed: May 17, 2021

(65) Prior Publication Data

US 2021/0380377 A1 Dec. 9, 2021

(30) Foreign Application Priority Data

Jun. 5, 2020 (JP) ..... JP2020-098541

(51) Int. Cl.
*B66C 23/90* (2006.01)
*B66C 23/60* (2006.01)

(52) U.S. Cl.
CPC ..... *B66C 23/905* (2013.01); *B66C 23/60* (2013.01)

(58) Field of Classification Search
CPC ..... B66C 23/26; B66C 23/34; B66C 23/60; B66C 23/905
See application file for complete search history.

(56) References Cited

U.S. PATENT DOCUMENTS 4,412,622 A 11/1983 Gyomrey

FOREIGN PATENT DOCUMENTS

JP 2000-281280 A 10/2000
JP 2017-178562 A 10/2017
(Continued)

OTHER PUBLICATIONS

Machine Translation of JP 2018/065662A. (Year: 2018).*
(Continued)

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

Provided is an apparatus capable of preventing an auxiliary cylinder attached to a derricking member of a working machine from undesirable rotational movement. The apparatus includes an auxiliary cylinder capable of making expansion and contraction motions, an auxiliary-cylinder angle detector, a fixing device, and an expansion controller. The fixing device fixes the auxiliary cylinder to the derricking member when the expansion length of the auxiliary cylinder is in the fixing allowing range, and releases the fixing of the auxiliary cylinder at other times. The expansion controller judges the posture of the auxiliary cylinder based on the auxiliary-cylinder angle detected by the auxiliary-cylinder angle detector, allows the expansion and contraction motions when the auxiliary cylinder is in the vertical posture, and prohibits the auxiliary expansion and contraction motions when the auxiliary cylinder is in a posture other than the vertical posture and the auxiliary cylinder is fixed to the derricking member.

7 Claims, 8 Drawing Sheets

(56) References Cited

FOREIGN PATENT DOCUMENTS

| | | | |
|---|---|---|---|
| JP | 2018-065662 | A | 4/2018 |
| JP | 6540653 | B2 * | 7/2019 |

OTHER PUBLICATIONS

Machine Translation of JP 6540653 B2. (Year: 2019).*
Extended European Search Report dated Nov. 12, 2021 in corresponding European Patent Application No. 21175202.7, 5 pages.

* cited by examiner

AUXILIARY CYLINDER APPARATUS, WORKING MACHINE INCLUDING SAME, AND USE OF AUXILIARY CYLINDER

BACKGROUND OF INVENTION

Technical Field

The present invention relates to an auxiliary cylinder apparatus including an auxiliary cylinder provided on a derricking member of a working machine so as to be swingable, a working machine including the same, and a method of using the auxiliary cylinder.

Description of the Background Art

There is a work machine, such as a crane, designed to be disassembled and assembled at a working site. Such type of working a machine may be provided with an auxiliary cylinder, for example, to assist a boom to be disassembled and assembled. The auxiliary cylinder is attached to a derricking member, for example, a mast.

The working machine including the auxiliary cylinder further includes means for fixing the auxiliary cylinder to the derricking member. However, there can be a case where the fixing of the auxiliary cylinder is released in a state where the derricking member is tilted, which may cause the auxiliary cylinder to be moved rotationally so as to leave forward from the derricking member to thereby collide with a boom or the like.

Japanese Unexamined Patent Application Publication No. 2017-178562 discloses a work machine intended to prevent an auxiliary cylinder from an undesirable swing motion as described above. The working machine includes a mast as a derricking member, an auxiliary cylinder, a cylinder fixing pin, a pin driving device, and a fixing plate. The fixing plate has a pin insertion hole, fixed to the auxiliary cylinder. The pin driving device is fixed to the mast to insert and remove the cylinder fixing pin with respect to the pin insertion hole. The cylinder fixing pin is inserted into the pin insertion hole to thereby fix the auxiliary cylinder to the mast. The cylinder fixing pin has a stepped part, which restrains the cylinder fixing pin from being removed from the pin insertion hole while the mast is tilted, thereby preventing the auxiliary cylinder from an undesirable swing motion due to the release of the fixing of the auxiliary cylinder while the mast is tilted.

The insertion and removal of the cylinder fixing pin, however, is performed through manual operation by the operator of the crane, which involves a possibility that the operator erroneously performs inappropriate removal of the cylinder fixing pin from the pin insertion hole.

SUMMARY OF INVENTION

It is an object of the present invention to provide an auxiliary cylinder apparatus capable of preventing an auxiliary cylinder from undesirable swing motion to a derricking member, a working machine including the same, and a method of using the auxiliary cylinder.

Provided is an auxiliary cylinder apparatus installed in a working machine including a derricking member capable of making a derricking motion of rotationally moving in a derricking direction. The apparatus includes an auxiliary cylinder, a fixing device, an auxiliary-cylinder angle detector, and an expansion controller. The auxiliary cylinder is attached to the derricking member so as to be capable of making a swing motion about an axis parallel to a rotation axis of the derricking motion to the derricking member, the auxiliary cylinder being capable of making expansion and contraction motions of expanding and contracting in expansion and contraction directions, the expansion and contraction directions intersecting a swing axis of the swing motion. The fixing device is configured to be capable of fixing the auxiliary cylinder to the derricking member only when an expansion length which is a length of the auxiliary cylinder in the expansion and contraction directions is within a predetermined fixing allowing range, and configured to release fixing of the auxiliary cylinder when the expansion length is deviated from the fixing allowing range. The auxiliary-cylinder angle detector detects an auxiliary-cylinder angle, which is the angle of the expansion and contraction directions of the auxiliary cylinder to a horizontal direction. The expansion controller performs an expansion control which is a control of the expansion and contraction motions of the auxiliary cylinder. The expansion control includes: judging whether the auxiliary cylinder is in a predetermined vertical posture, based on the auxiliary-cylinder angle detected by the auxiliary-cylinder angle detector; allowing the auxiliary cylinder to make the expansion and contraction motions when the auxiliary cylinder is in the vertical posture; and prohibiting the expansion cylinder from the expansion and contraction motions that deviates the expansion length from the fixing allowing range when the auxiliary cylinder is in a posture other than the vertical posture in a state where the auxiliary cylinder is fixed to the derricking member by the fixing device.

Also provided is a method for using an auxiliary cylinder attached to a derricking member of a work machine including a derricking member capable of making a derricking motion of rotationally moving in a derricking direction, the auxiliary cylinder being attached to the derricking member so as to be capable of making a swing motion about a swing axis in a direction parallel to a center axis of a rotational movement of the derricking member in the derricking direction and being capable of making expansion and contraction motions of expanding and contracting in expansion and contraction directions orthogonal to the swing axis. The method includes installing a fixing device in the work machine, the fixing device being configured to be capable of fixing the auxiliary cylinder to the derricking member only when an expansion length, which is a length of the auxiliary cylinder in the expansion and contraction directions, is within a predetermined fixing allowing range and configured to release fixing of the auxiliary cylinder when the expansion length is deviated from the fixing allowing range; detecting an auxiliary-cylinder angle which is an angle of the auxiliary cylinder to the horizontal direction in the expansion and contraction directions; judging whether or not the auxiliary cylinder is in a predetermined vertical posture based on the detected auxiliary-cylinder angle; and performing an expansion and contraction control, which is a control of the expansion and contraction motions of the auxiliary cylinder. The expansion and contraction control includes: switching between a fixing state where the auxiliary cylinder is fixed to the derricking member by the fixing device and a fixing release state where the fixing of the auxiliary cylinder by the fixing device is released, by causing the auxiliary cylinder to make the expansion and contraction motions when the auxiliary cylinder is in the vertical posture; and prohibiting the auxiliary cylinder from the expansion and contraction motions that deviates the expansion length from the fixing allowing range, when the auxiliary cylinder is in a posture other than the vertical posture in a state where the auxiliary cylinder is fixed to the derricking member by the fixing device.

DESCRIPTION OF EMBODIMENT

Hereinafter will be described a preferred embodiment of the present invention with reference to the accompanying drawings.

Figure 1:
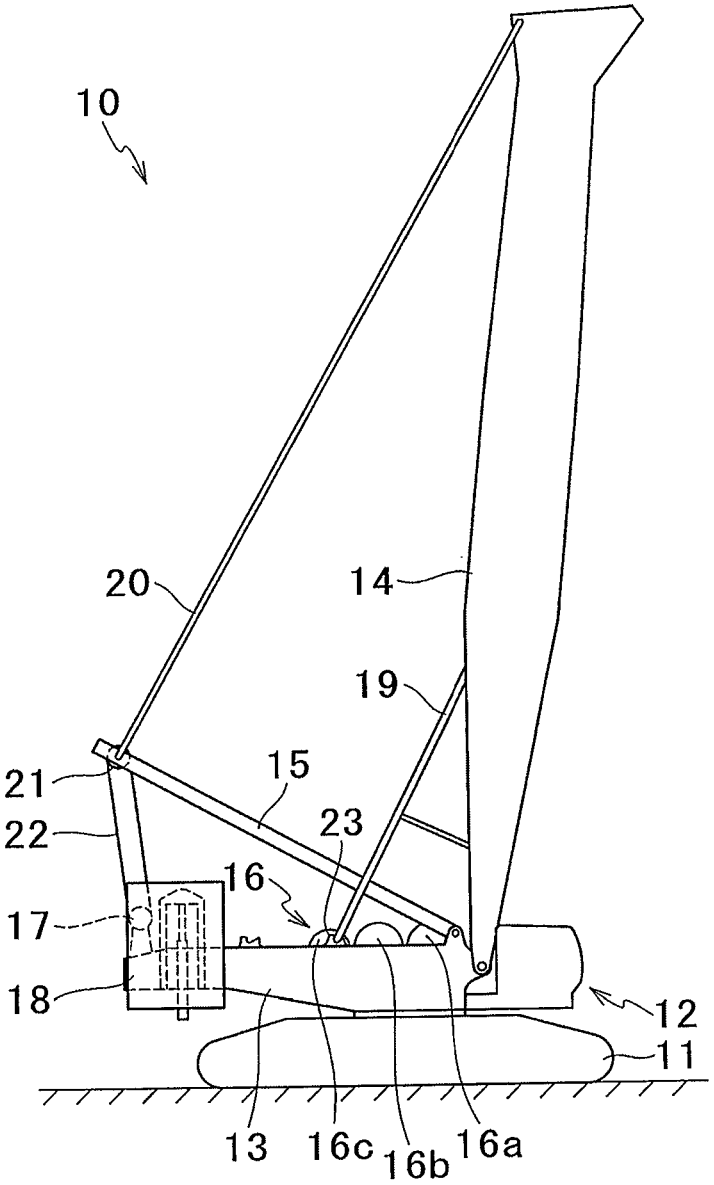
FIG. 1 is a side view of a crane according to an embodiment of the present invention, the crane being assembled.

FIG. 1 is a side view of a crane 10 according to the embodiment, the crane 10 being an example of a work machine. In the crane 10 shown in FIG. 1, performed are hoisting and lowering of a not-graphically-shown load. The crane 10 includes a crawler type lower traveling body 11, and an upper slewing body 12 mounted on the lower traveling body 11 so as to be slewable. The work machine according to the present invention is not limited to such a crawler type crane, but also allowed to be a wheel type crane.

The upper slewing body 12 includes a slewing frame 13, a boom 14, a mast 15, a winch device 16, a lower spreader 17, a counterweight 18, and a backstop device 19.

The slewing frame 13 is mounted on the lower traveling body 11 through a not-graphically-shown slewing bearing. The boom 14 is connected to the front part portion of the slewing frame 13 so as to be capable of making a derricking motion. The derricking motion is a motion of the boom 14 to move rotationally in a derricking direction to the slewing frame 13. The boom 14 includes a lower boom member, at least one intermediate boom member, and an upper boom member.

The mast 15 is a derricking member, being connected to the slewing frame 13 so as to be capable of making the derricking motion to the slewing frame 13 on the rear side of the boom 14. The derricking motion is a motion of rotationally moving in a derricking direction relatively to the slewing frame 13. The mast 15 and the boom 14 have respective distal ends, which are connected to each other through a guilink 20.

The winch device 16 is disposed in a center part of the slewing frame 13. The winch device 16 includes a plurality of winches, each of which performs winding and unwinding a wire rope. The winch device 16 performs hoisting and lowering the hoisting load, derricking the boom 14, and the like. The winch device 16 according to the present embodiment includes a main winding winch 16*a*, an auxiliary winding winch 16*b*, and a derricking winch 16*c*, which are arranged in this order from the front side to the rear side of the slewing frame 13.

The lower spreader 17 is disposed in the rear part of the slewing frame 13. The upper spreader 21 is disposed in the distal end of the mast 15. The upper spreader 21 and the lower spreader 17 are connected to each other through a boom derricking rope 22. The derricking winch 16*c* of the winch device 16 performs winding and unwinding the boom derricking rope 22, thereby bringing the mast 15 into the derricking motion. The derricking motion of the mast 15 causes the derricking motion of the boom 14.

The counterweight 18 is mounted on the rear part of the slewing frame 13. The backstop device 19 is attached to the back surface of the boom 14 to extend from the back surface toward the slewing frame 13. The backstop device 19 can be received in the backstop receiver 23 fixed to the slewing frame 13 to thereby restrict the backward slewing motion of the boom 14.

The crane 10 is disassembled and assembled at the working site. The crane 10 can be disassembled into a plurality of portions, which are distributedly stacked on a plurality of conveying vehicles, e.g. trailers, to be conveyed to the next working site and reassembled at the next working site.

Figure 2:
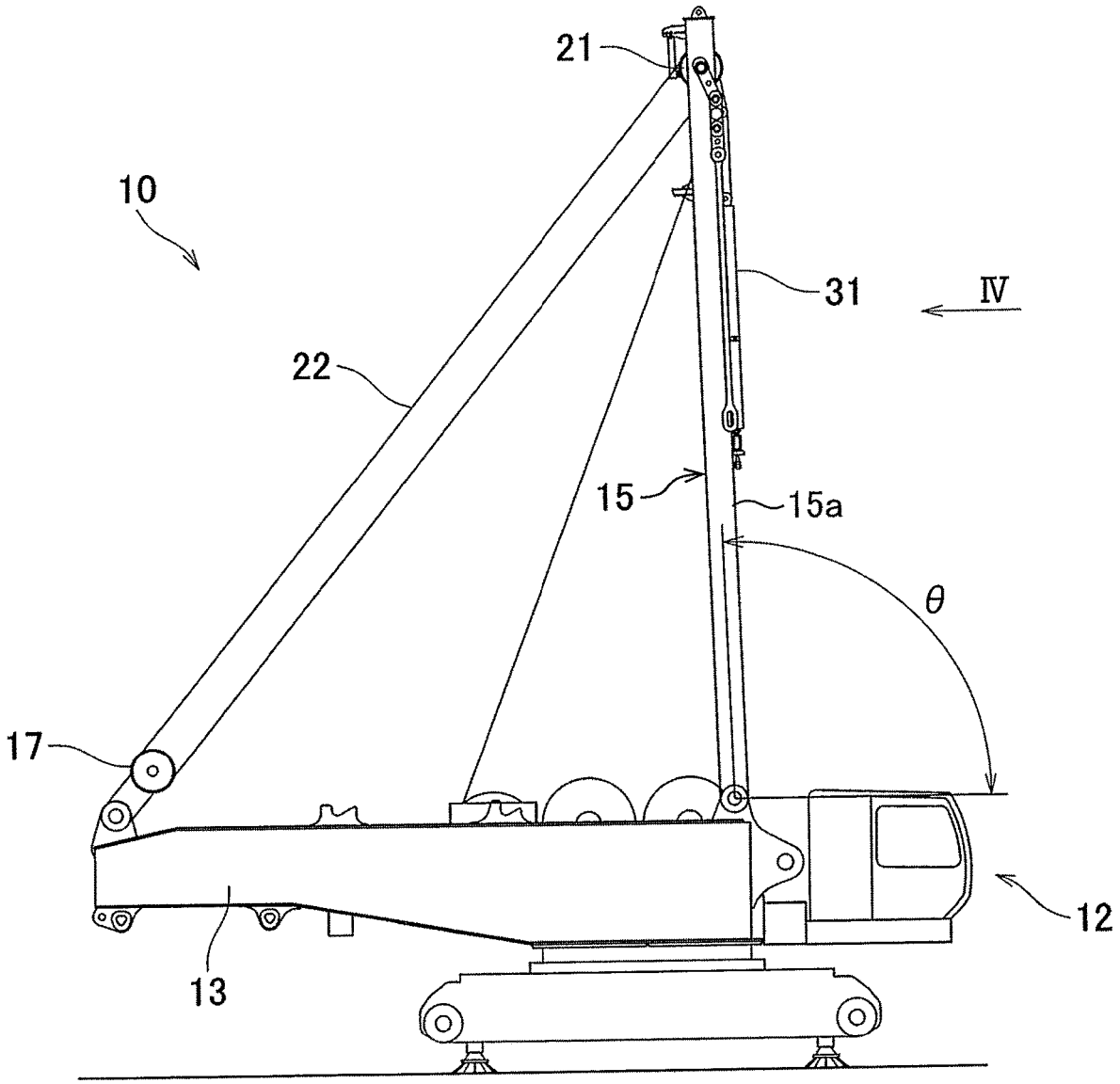
FIG. 2 is a side view of the crane, which is disassembled to bring each of a mast and an auxiliary cylinder into a vertical posture.
Figure 3:
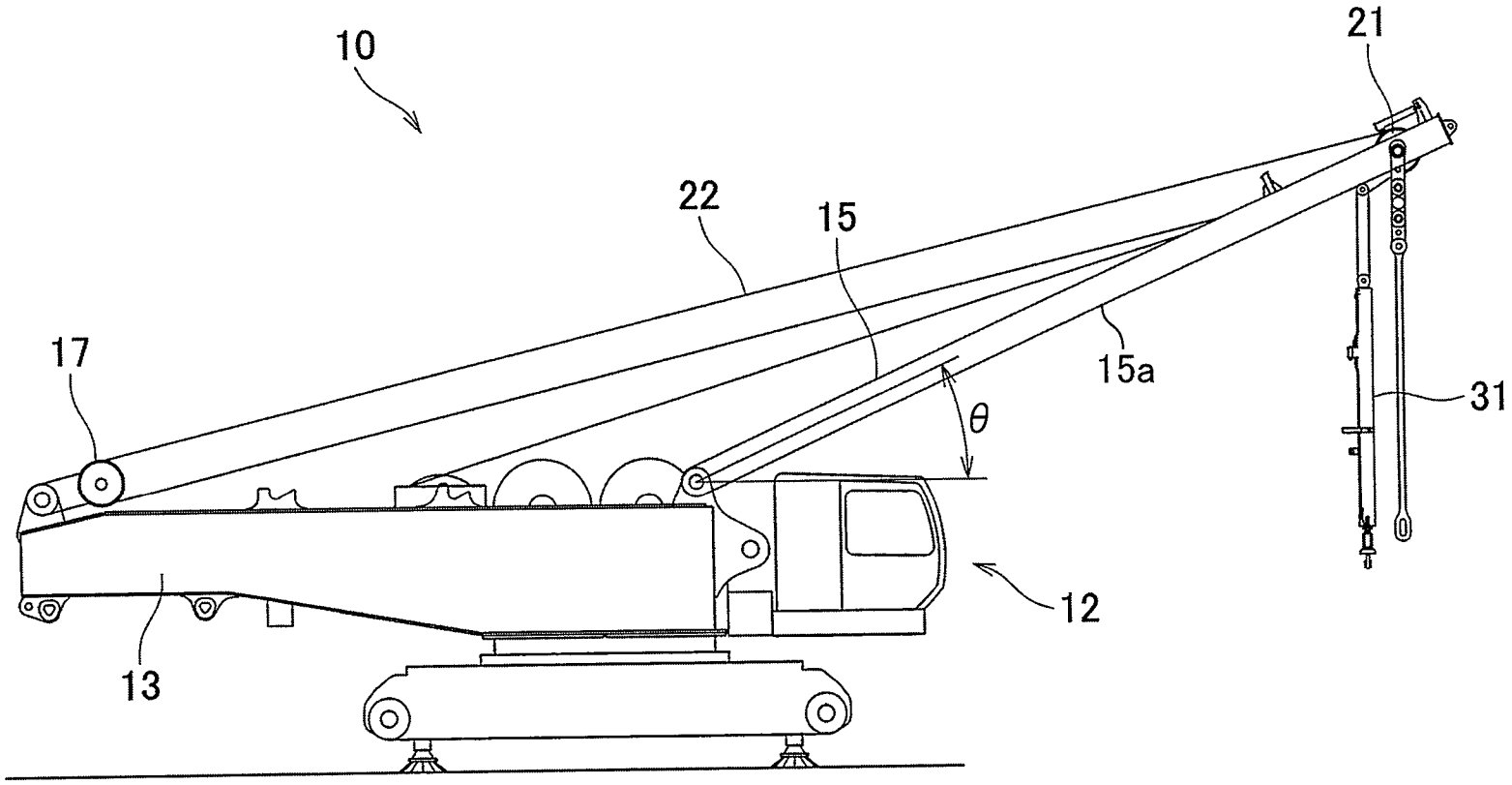
FIG. 3 is a side view of the crane, which is disassembled to tilt the mast while bringing the auxiliary cylinder into a vertical posture.

FIGS. 2 and 3 are side views of the thus disassembled crane 10. As shown in FIGS. 2 and 3, the disassembly of the crane 10 involves removal of the boom 14 from the upper slewing body 12. The disassembly also involves removal of the counterweight 18 from the upper slewing body 12 and removal of the crawler from the lower traveling body 11.

As shown in FIGS. 2 and 3, the crane 10 further includes an auxiliary cylinder 31. The auxiliary cylinder 31 is a hydraulic cylinder, being capable of making expansion and contraction motions of expanding and contracting in expansion and contraction directions. The auxiliary cylinder 31 is attached to the mast 15 so as to be capable of making a swing motion in a swing direction.

The auxiliary cylinder 31 is disposed on the front side, that is, on the right side in FIGS. 1 and 2, of a belly surface 15*a* of the mast 15. The belly surface 15*a* is a surface that faces downward when the mast 15 is in the falling posture shown in FIG. 3, the falling posture being a posture in which the mast 15 falls to be substantially parallel to the ground.

The auxiliary cylinder 31 includes a cylinder body 31*a* and a rod 31*b*. The rod 31*b* is displaceable relatively to the cylinder body 31*a* in the axis direction of the auxiliary cylinder 31, i.e. movable in both a direction to protrude from the cylinder body 31*a* and a direction to retract into the cylinder body 31*a*, which allows the entire auxiliary cylinder 31 to expand and contract in the expansion and contraction directions. The auxiliary cylinder 31 has a cylinder upper end which is swingably connected to the mast 15 and a cylinder lower end which is a free end opposite to the cylinder upper end. The cylinder upper end is one of opposite ends in the axial direction of the cylinder body 31*a*. The lower end of the cylinder is the other of the opposite ends, being the distal end of the rod 31*b* in this embodiment.

The swing direction of the auxiliary cylinder 31 is the same as the aforementioned derricking direction of the mast 15, being a direction in which the auxiliary cylinder 31 is rotationally moved about a lateral swing axis perpendicular to the longitudinal direction of the mast 15, that is, the lateral direction in FIG. 2 and FIG. 3. The swing axis is parallel to the rotation axis of the derricking motion. The auxiliary cylinder 31 is attached to the mast 15 so as to make the expansion and contraction directions intersect with the swing axis, in this embodiment, orthogonal thereto. The auxiliary cylinder 31 is used to allow the crane to attach and detach the boom 14 and the crawler by itself when the crane 10 is assembled and disassembled.

FIG. 2 shows a state where the mast 15 and the auxiliary cylinder 31 are in respective predetermined vertical postures. The vertical posture of the auxiliary cylinder 31, in this embodiment, is defined as a posture where the expansion and contraction directions of the auxiliary cylinder 31, which is the longitudinal direction (axial direction) of the auxiliary cylinder 31, is exactly vertical or tilted from the vertical direction only at an allowable angle that has an absolute value equal to or less than 10 degrees. Similarly, the vertical posture of the mast 15 is defined as a posture where the longitudinal direction of the mast 15, that is, the radial direction of the rotational movement of the mast 15, is exactly vertical or tilted from the vertical direction only at an allowable angle that has an absolute value equal to or less than 10 degrees. In FIG. 2, both the mast 15 and the auxiliary cylinder 31 are in the vertical postures. Specifically, the angle θ shown in FIG. 2, is 92 degrees, which is equal to respective angles of the longitudinal direction of the mast 15 and the expansion and contraction directions of the auxiliary cylinder 31 to the horizontal plane.

FIG. 3 shows a state where the auxiliary cylinder 31 is in the vertical posture whereas the mast 15 is greatly tilted from the vertical direction. In this state, assembly and disassembly work is performed with use of the auxiliary cylinder 31. In FIG. 3, the tilt angle θ of the longitudinal inclination of the mast 15 to the horizontal plane is 25 degrees.

Figure 4:
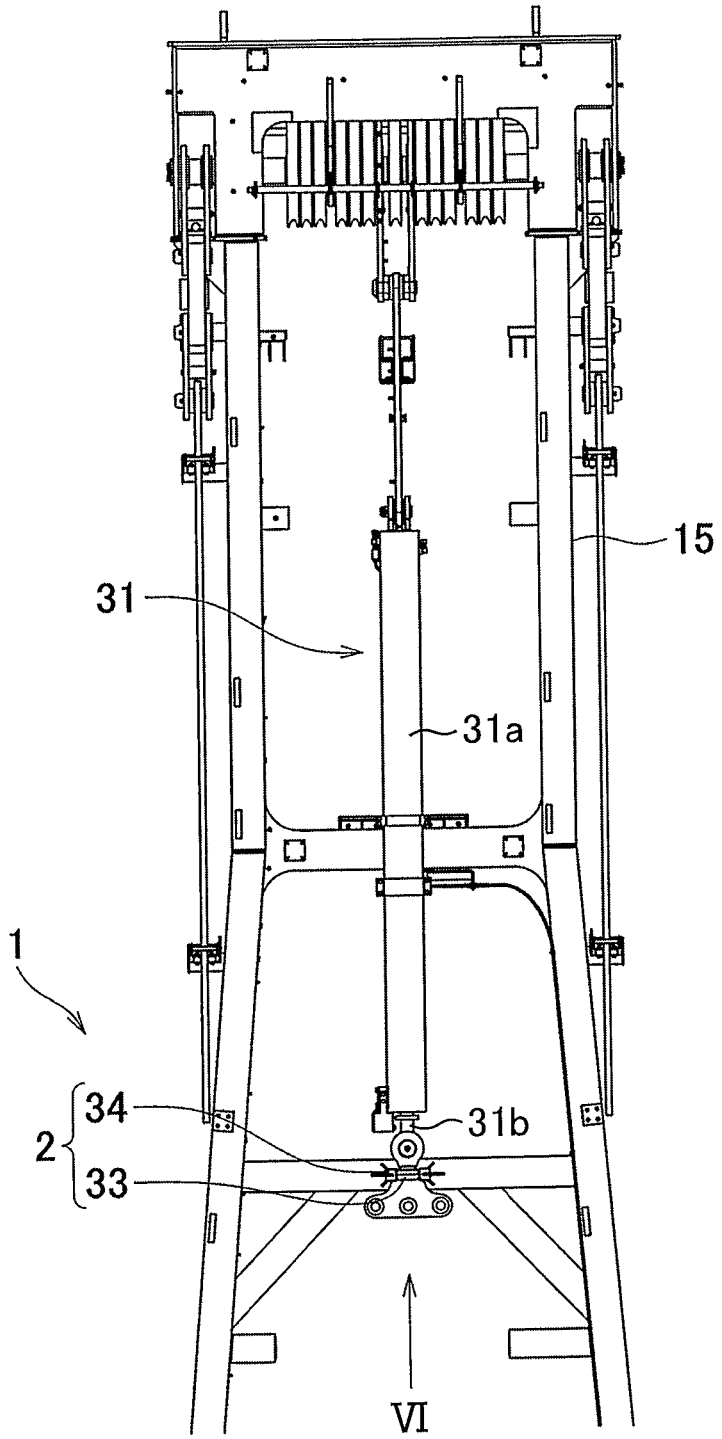
FIG. 4 is a view showing a state where the auxiliary cylinder is fixed to the mast, in a direction indicated by an arrow IV in FIG. 2.
Figure 5:
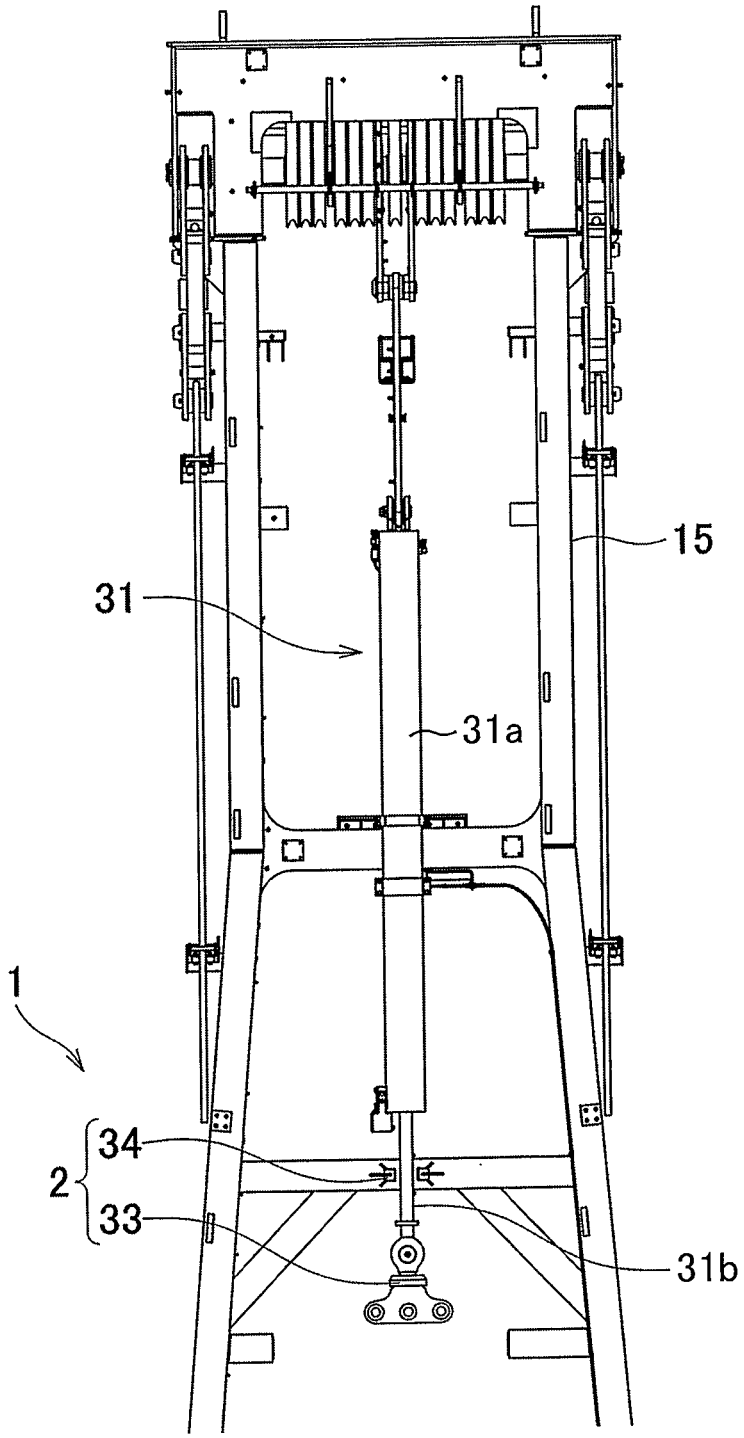
FIG. 5 is a view showing a state where fixing of the auxiliary cylinder to the mast is released, in the direction indicated by the arrow IV in FIG. 2.

FIGS. 4 and 5 are views of the mast 15 shown in FIG. 2 taken along the direction indicated by an arrow IV in FIG. 2. The crane 10 includes an auxiliary cylinder apparatus 1 shown in FIGS. 4 and 5, the auxiliary cylinder apparatus 1 including the auxiliary cylinder 31 and a fixing device 2. The fixing device 2 is configured to be capable of fixing the auxiliary cylinder 31 to the mast 15 when an expansion length of the auxiliary cylinder 31 is within a predetermined fixing allowing range, in a state where the auxiliary cylinder 31 is along the mast 15, in other words, when the length of the part that protrudes from the cylinder body 31*a* out of the rod 31*b* of the auxiliary cylinder 31 is within a predetermined range. The expansion length is the length of the auxiliary cylinder 31 in the expansion and contraction directions, i.e. the length in the axial direction. On the other hand, the fixing device 2 is configured to release fixing of the auxiliary cylinder 31 to the mast 15 when the expansion length of the auxiliary cylinder 31 is deviated from the fixing allowing range, even when the auxiliary cylinder 31 extends along the mast 15.

Specifically, the fixing device 2 according to this embodiment includes a restraint target member 33 and a restraining member 34. The restraint target member 33 and the restraining member 34 are engageable with each other.

The restraint target member 33 is fixed to a predetermined part of the auxiliary cylinder 31. Specifically, the predetermined part is a part that is displaced relatively to the mast 15, which is the derricking member, by the expansion and contraction motions of the auxiliary cylinder 31, being the distal end of the rod 31*b* of the auxiliary cylinder 31 in this embodiment. The restraint target member 33 has a cylindrical outer peripheral surface, which has a diameter, namely, the outer diameter of the restraint target member 33, larger than the outer diameter of the rod 31*b*.

Figure 6:
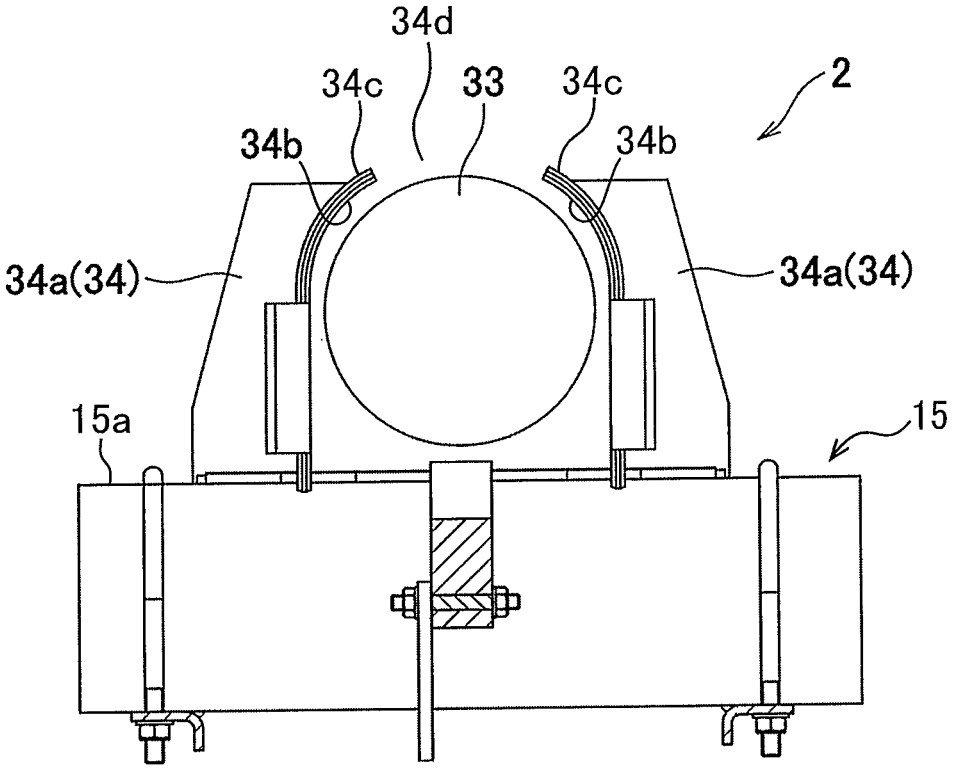
FIG. 6 is a partially cross-sectional view showing the state shown in FIG. 4, in the direction indicated by the arrow VI in FIG. 4.

The restraining member 34 is fixed to a predetermined part of the mast 15, which part is in the belly surface 15*a* in this embodiment, as shown in FIGS. 4-6. FIG. 6 is a view of the fixing device 2 shown in FIG. 4, in the direction indicated by the arrow VI of FIG. 4. As shown in FIG. 6, the restraining member 34 includes a pair of restraining portions 34*a*. The pair of restraining portions 34*a* are disposed on both right and left sides across a space which is capable of receiving the restraint target member 33. Specifically, the pair of restraining portions 34*a* has respective cylindrical inner peripheral surfaces 34*b* slightly larger than the cylindrical outer peripheral surface of the restraint target member 33, and the pair of restraining portions 34*a* are arranged so as to allow the rod 31*b* to pass between the respective inner peripheral surfaces 34*b* of the pair of restraining portions 34*a*. The pair of restraining portions 34*a* have respective outer ends 34*c* farthest from the belly surface 15*a*, forming a gap 34*d* in the left-right direction between the respective outer ends 34*c*. The gap 34*d* has a dimension (lateral dimension) that allows the rod 31*b* to pass through the gap 34*d* but prevents the restraint target member 33 from passing through the gap 34*d*. Specifically, the dimension of the gap 34*d* is larger than the outer diameter of the rod 31*b* and smaller than the outer diameter of the restraint target member 33.

As shown in FIG. 4, when the expansion length of the auxiliary cylinder 31 is set to a predetermined fixing allowing length, e.g., the minimum length in this embodiment, that is, the auxiliary cylinder 31 is most contracted, in a state where the mast 15 and the auxiliary cylinder 31 are in respective vertical postures, the restraint target member 33 having the outer diameter larger than the outer diameter of the rod 31*b* in the auxiliary cylinder 31 is positioned between the pair of restraining portions 34*a*, as shown in FIG. 6. In this state, the restraint target member 33 is prevented from passing through the gap 34*d* between the pair of restraining portions 34*a* to be displaced in the direction of leaving the belly surface 15*a*. The restraint target member 33 is, thus, restrained by the pair of restraining portions 34*a*, and the auxiliary cylinder 31 is substantially fixed to the belly surface 15*a* of the mast 15. This prevents the auxiliary cylinder 31 from making a swing motion in the aforementioned swing direction, namely, the direction perpendicular to the paper surface in FIG. 4, even if the mast 15 is tilted in this state, because of the prevention of the restraint target member 33 from passing through the gap 34*d*.

On the other hand, as shown in FIG. 5, when the expansion length of the auxiliary cylinder 31 is increased to be deviated from the fixing allowing range, that is, the auxiliary cylinder 31 is expanded, in a state where the mast 15 and the auxiliary cylinder 31 are in respective vertical postures, the restraint target member 33 is deviated downward from the pair of restraining portions 34*a*, and the rod 31*b* on the upper side of the restraint target member 33 is located between the pair of restraining portions 34*a*. Since the rod 31*b* has the outer diameter that allows the rod 31*b* to pass through the gap 34*d*, the fixing of the auxiliary cylinder 31 to the mast 15 is substantially released. When the mast 15 is tilted in this state, the auxiliary cylinder 31 is rotationally moved in the swing direction perpendicular to the paper surface in FIG. 5 with the passage of the rod 31*b* through the gap 34*d*.

Figure 7:
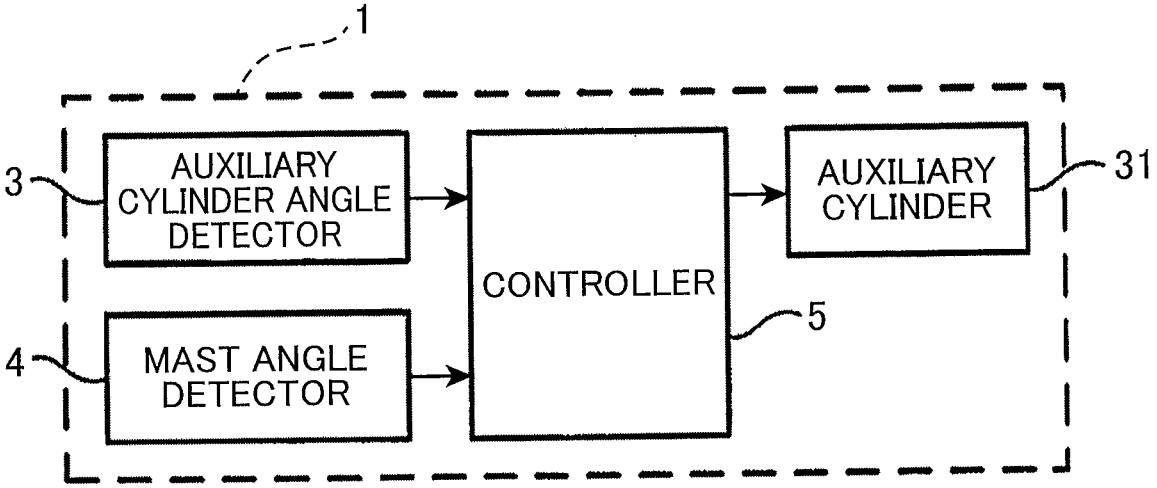
FIG. 7 is a block diagram showing main components of the auxiliary cylinder apparatus installed in the crane.

FIG. 7 is a block diagram showing main components of the auxiliary cylinder apparatus 1. As shown in FIG. 7, the main components include an auxiliary-cylinder angle detector 3, a mast angle detector 4, and a controller 5.

The auxiliary-cylinder angle detector 3 detects an auxiliary-cylinder angle. The auxiliary-cylinder angle is the angle of the longitudinal direction, namely, the expansion and contraction directions, of the auxiliary cylinder 31 to the horizontal direction. The auxiliary-cylinder angle detector 3 includes, for example, an inclination detector that is attached to the auxiliary cylinder 31 to detect the inclination angle of the auxiliary cylinder 31 or an angle detector that is attached to the proximal end of the auxiliary cylinder 31 to detect the angle of the auxiliary cylinder 31 to the mast 15.

The mast angle detector 4 is a derricking-member angle detector for detecting the derricking-member angle. The derricking-member angle is a mast angle in this embodiment, the mast angle being an angle of the longitudinal direction of the mast 15 to the horizontal direction, namely, the angle θ shown in FIGS. 2 and 3. The mast angle detector 4 includes, for example, an inclination detector mounted on the mast 15 to detect the inclination angle of the mast 15, or an angle detector mounted on a proximal end of the mast 15 to detect the angle of the mast 15 to the slewing frame 13.

The auxiliary-cylinder angle may be, alternatively, detected by use of a measurement value provided by a ranging sensor for measuring the distance between a specific part (for example, a distal end) of the auxiliary cylinder 31 and the mast 15, and the angle of the longitudinal direction of the mast 15 to the horizontal direction.

The controller 5 is an expansion controller that controls the expansion and contraction motions of the auxiliary cylinder 31, i.e. the relative motion of the rod 31*b* to the cylinder body 31*a* of the auxiliary cylinder 31 in the expansion and contraction directions. The controller 5 includes an auxiliary-cylinder posture judgment part, and an expansion and contraction operation part. The auxiliary-cylinder posture judgment part judges whether or not the auxiliary cylinder 31 is in the vertical posture, based on the auxiliary-cylinder angle detected by the auxiliary-cylinder angle detector 3. The expansion and contraction operation part allows the auxiliary cylinder 31 to make expansion and contraction motions (relative movement of the rod 31*b* to the cylinder body 31*a*) when the auxiliary cylinder 31 is in the vertical posture.

As shown in FIG. 2, when the mast 15 and the auxiliary cylinder 31 are in the respective vertical postures, the auxiliary cylinder 31 makes substantially no swing motion even if the expansion and retraction length of the auxiliary cylinder 31 is increased to be deviated from the fixing allowing range to cause the fixing of the auxiliary cylinder 31 to the mast 15 to be released. Besides, as shown in FIG. 3, when the auxiliary cylinder 31 is in the vertical posture whereas the mast 15 is in the tilt posture, it can be judged that the fixing of the auxiliary cylinder 31 to the mast 15 is released, but the auxiliary cylinder 31 makes no swing motion regardless of the expansion and contraction motions of the auxiliary cylinder 31. In short, when the auxiliary cylinder 31 is in the vertical posture, the auxiliary cylinder 31 makes no rotational movement in the direction of leaving the mast 15.

Figure 8:
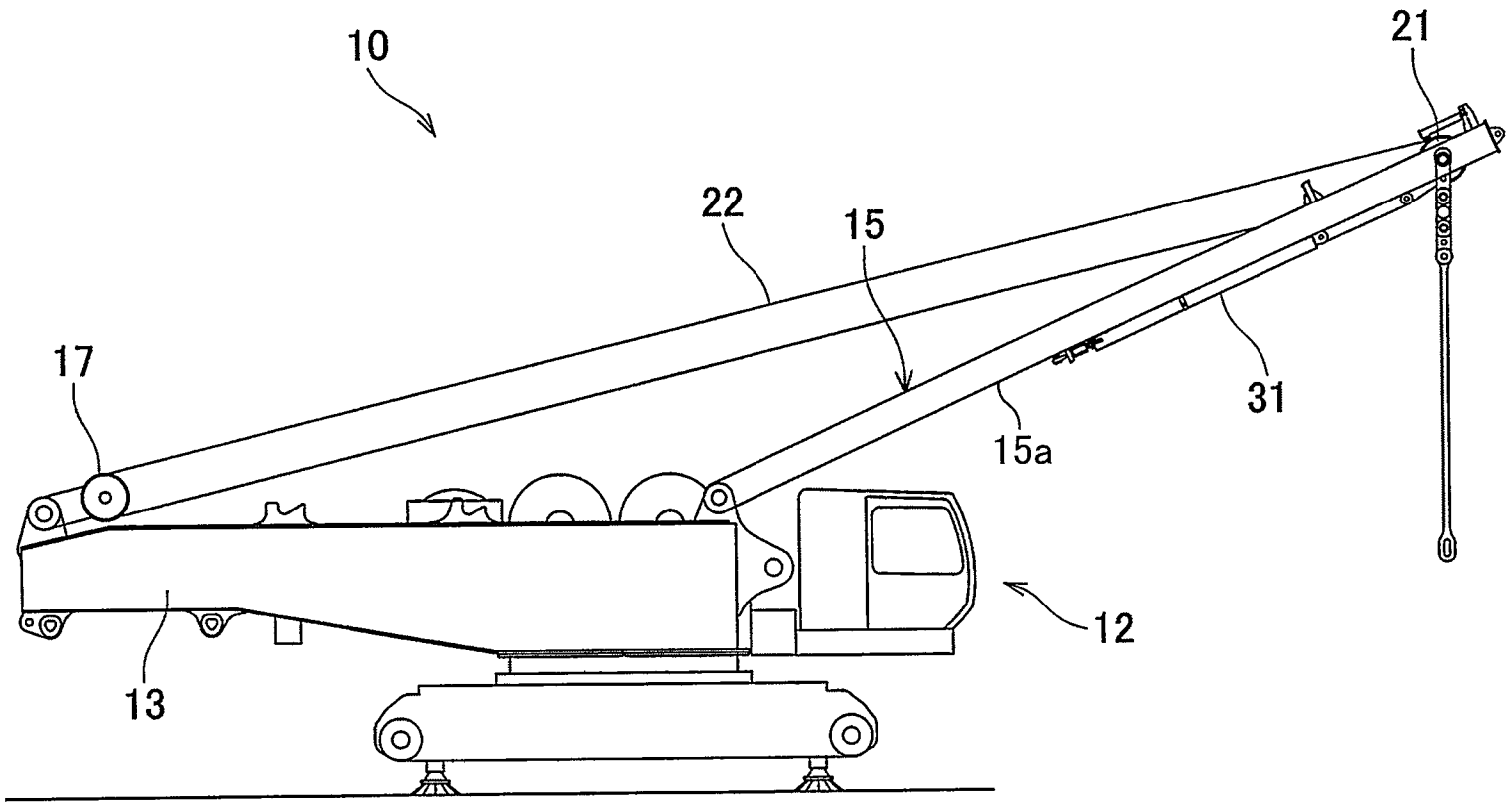
FIG. 8 is a side view of the crane, which is disassembled to tilt each of the mast and the auxiliary cylinder.

On the other hand, if the auxiliary cylinder 31 is expanded to cause the fixing of the auxiliary cylinder 31 to the mast 15 to be released in a state where the mast 15 and the auxiliary cylinder 31 are tilted at the same angle while the auxiliary cylinder 31 is still fixed to the mast 15 as shown in FIG. 8, the auxiliary cylinder 31 will be rotationally moved in a direction of leaving the belly surface 15*a* of the mast 15 by gravity acting on the auxiliary cylinder 31.

To prevent such rotational movement, the controller 5 prohibits the auxiliary cylinder 31 from the expansion and contraction motions, when a detected-angle difference and a fixing-state-angle difference coincide with each other and the auxiliary cylinder 31 is in a posture other than the vertical posture. The detected-angle difference is a difference between the auxiliary-cylinder angle detected by the auxiliary-cylinder angle detector 3 and the mast angle detected by the mast angle detector 4. The fixing-state-angle difference is a difference between the mast angle and the auxiliary-cylinder angle in a fixing state where the auxiliary cylinder 31 is fixed to the mast 15. In this embodiment, the fixing-state-angle difference is 0. In other words, the mast angle and the auxiliary-cylinder angle coincide with each other in the fixed state. The controller 5 according to this embodiment, therefore, is configured to prohibit the auxiliary cylinder 31 from the expansion and contraction motions when the auxiliary-cylinder angle detected by the auxiliary-cylinder angle detector 3 coincides with the mast angle detected by the mast angle detector 4 and the auxiliary cylinder 31 is in a posture other than the vertical posture. This keeps the auxiliary cylinder 31 be fixed to the mast 15 to thereby prevent the auxiliary cylinder 31 from undesired rotational movement in the direction of leaving the mast 15 due to the release of the fixing.

Figure 9:
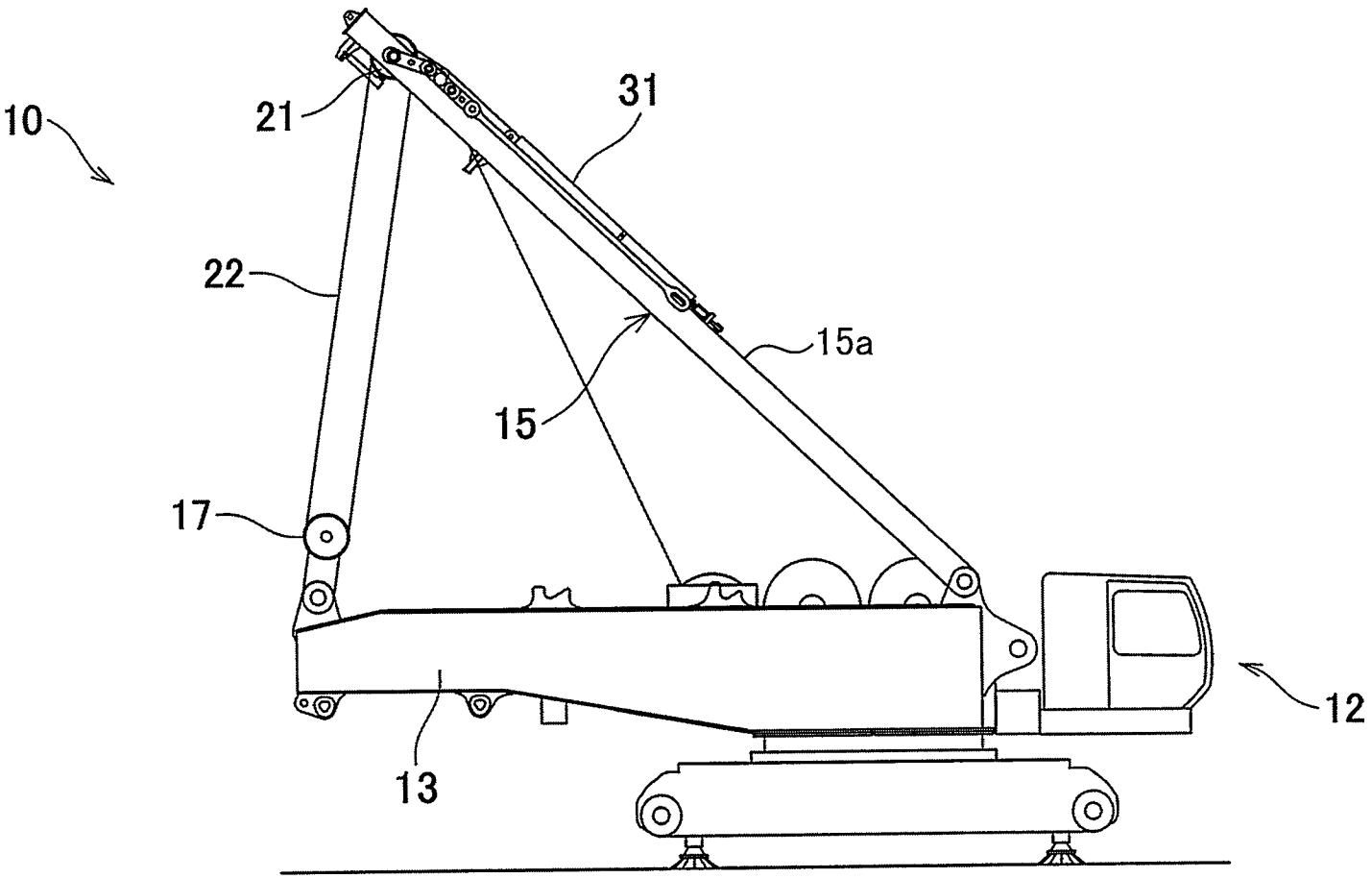
FIG. 9 is a side view of the crane which is disassembled to be in a specific tilt posture where a belly surface of the mast faces upward.

On the other hand, when the mast 15 is in a specific tilted posture of being tilted such that the belly surface 15*a* faces upward as shown in FIG. 9, the auxiliary cylinder 31 is held in a placement state of being placed on the belly surface 15*a* of the mast 15, regardless of whether or not the auxiliary cylinder 31 is fixed to the mast 15. If the fixing of the auxiliary cylinder 31 to the mast 15 is released in the placement state, the auxiliary cylinder 31 may be rotationally moved in a direction of leaving the mast 15 by the force caused when the mast 15 is raised from the specified tilted posture.

To prevent such undesirable rotational movement, the controller 5 further includes a derricking-member tilt judgment part that judges whether or not the mast 15 is in a specific tilt posture where the mast 15 is tilted to make the belly surface 15*a* face upward, based on the mast angle detected by the mast angle detector 4, and the expansion and contraction operation part prohibits the auxiliary cylinder 31 from the expansion and contraction motions when the mast 15 is in the specific tilt posture. This prevents the fixing of the auxiliary cylinder 31 to the mast 15 from being released when the mast 15 is in the specific tilt posture. Thus keeping the state where the auxiliary cylinder 31 is fixed to the mast 15 prevents the auxiliary cylinder 31 from being rotationally moved in the direction of leaving the belly surface 15*a* of the mast 15 by the force caused when the mast 15 is raised from the specific tilt posture.

Next will be described the action of the auxiliary cylinder apparatus 1 and the method of using the auxiliary cylinder 31 based on the action, with reference to the drawings.

As shown in FIGS. 2 and 3, at the time of disassembly and assembly, the auxiliary-cylinder angle detector 3 detects the angle of the expansion and contraction directions of the auxiliary cylinder 31 (longitudinal direction in this embodiment) to the horizontal direction, namely, the auxiliary-cylinder angle (auxiliary-cylinder angle detection step). The controller 5 judges whether or not the auxiliary cylinder 31 is in the predetermined vertical posture based on the auxiliary-cylinder angle detected in the auxiliary-cylinder angle detecting step, and allows the auxiliary cylinder 31 to expand and contract when the auxiliary cylinder 31 is in the vertical posture (expansion and contraction control step). For example, when an expansion and contraction command is input to the controller 5 by the operator, the controller causes the auxiliary cylinder 31 to be expanded or contracted based on the expansion and contraction command.

When the expansion length of the auxiliary cylinder 31 is set to a length within a predetermined fixing allowing range, in this embodiment a minimum length, in a state where the mast 15 and the auxiliary cylinder 31 are in respective vertical postures as shown in FIG. 2, the restraint target member 33 is restrained between the pair of restraining portions 34*a* of the restraining member 34 as shown in FIG. 6, whereby the auxiliary cylinder 31 is fixed to the mast 15 (fixing step). On the other hand, when the auxiliary cylinder 31 is expanded enough to deviate the expansion length of the auxiliary cylinder 31 from the fixing allowing range in the state where the mast 15 and the auxiliary cylinder 31 are in respective vertical postures, the restraint target member 33 is deviated downward from the position between the pair of restraining portions 34*a* of the restraining member 34, thereby causing the fixing of the auxiliary cylinder 31 to the mast 15 to be released (release step).

In such a state where the mast 15 and the auxiliary cylinder 31 are in respective vertical postures, the auxiliary cylinder 31 makes no swing motion even if the expansion length of the auxiliary cylinder 31 is deviated from the fixing allowing range to cause the fixing of the auxiliary cylinder 31 to the mast 15 to be released. Besides, even when the mast 15 is tilted, the auxiliary cylinder 31 makes no swing motion regardless of the expansion and contraction motions of the auxiliary cylinder 31, if the fixing of the auxiliary cylinder 31 to the mast 15 has been already released and the auxiliary cylinder 31 is in the vertical posture. In short, regardless of the fixing of the auxiliary cylinder 31 or the release of the fixing, no rotational movement of the auxiliary cylinder 31 occurs in the direction of leaving the mast 15.

On the other hand, in a state where the detected-angle difference, which is the difference between the auxiliary-cylinder angle detected by the auxiliary-cylinder angle detector 3 and the auxiliary-cylinder angle detected by the mast angle detector 4, coincides with the predetermined fixing-state-angle difference (in this embodiment, the detected angle difference is 0, that is, the auxiliary-cylinder angle and the fixing-state-angle difference coincide with each other), and the auxiliary cylinder 31 is in a posture other than the vertical posture, it can be estimated that the mast 15 and the auxiliary cylinder 31 are in the same tilt postures while the auxiliary cylinder 31 is fixed to the mast 15. In this case, the controller 5 prohibits the auxiliary cylinder 31 from the expansion and contraction motions. For example, the controller 5 prevents the auxiliary cylinder 31 from the expansion and contraction motions regardless of the input of the expansion and contraction command by the operator. This keeps the auxiliary cylinder 31 be fixed to the mast 15 to prevent the auxiliary cylinder 31 from being rotationally moved so as to leave the mast 15 along with the release of the fixing.

In the case where the auxiliary cylinder 31 is in a posture other than a vertical posture, namely, a tilted posture, in a state where the detected-angle difference is not coincident with the fixing-state-angle difference (a state where the detected auxiliary-cylinder angle and the detected mast angle are not coincident in this embodiment), that is, a state that allows the fixing of the auxiliary cylinder 31 to the mast 15 to be regarded as being released, it is optional whether the controller 5 allows or prohibits the expansion and contraction motions.

In this case, allowing the auxiliary cylinder 31 to make the expansion and contraction motions increases the degree of freedom of use of the auxiliary cylinder 31. Specifically, can be prevented the expansion and contraction motions of the auxiliary cylinder 31 from being unnecessarily restricted by the tilt of the auxiliary cylinder 31 during the use of the auxiliary cylinder 31 which is not fixed to the mast 15. For example, when the mast 15 is so greatly lowered as to allow something to be hung by use of the auxiliary cylinder 31, an operator can manually adjust the expansion length of the auxiliary cylinder 31.

In contrast, prohibiting the auxiliary cylinder 31 from the expansion and contraction motions in the above case makes it possible to prevent a trouble caused by unintentional performance of the expansion and contraction motions. For example, the auxiliary cylinder 31 can be prevented from being unexpectedly expanded, in a state where the mast 15 is greatly lowered, to come into contact with other object lying under the auxiliary cylinder 31 to thereby damage the object or the auxiliary cylinder 31 itself.

Besides, in a state where the mast 15 is in a specific tilt posture where the belly surface 15*a* faces upward, that is, in a state where the auxiliary cylinder 31 is placed on the belly surface 15*a*, the controller 5 prohibits the auxiliary cylinder 31 from the expansion and contraction motions to keep the auxiliary cylinder 31 fixed to the mast 15. This enables the auxiliary cylinder 31 to be prevented from being rotationally moved in the direction of leaving the mast 15 by the force caused when the mast 15 is raised from the specific tilt posture.

While the embodiments of the present invention have been described above, specific examples are merely exemplified, and the present invention is not particularly limited, and specific configurations and the like can be appropriately modified in design. In addition, the action and effect described in the embodiment of the invention are merely listed the most suitable action and effect resulting from the present invention, and the action and effect according to the present invention are not limited to those described in the embodiment of the present invention.

For example, while the auxiliary cylinder 31 in the above-described embodiment is fixed to the mast 15 when the expansion length of the auxiliary cylinder 31 is the minimum expansion length, that is, the fixing allowing range is set to a range including the minimum length, the fixing allowing range can be freely set. For example, the fixing allowing range may be set to a range including the maximum expansion length. In summary, the fixing device may be configured to fix the auxiliary cylinder 31 to the mast 15 when the expansion length is maximum. The fixing allowing range, alternatively, may be set to a certain intermediate range between the maximum expansion length and the minimum expansion length. In other words, the fixing device may be configured to fix the auxiliary cylinder 31 to the mast 15 when the expansion length of the auxiliary cylinder 31 is a predetermined intermediate expansion length.

The fixing device according to the present invention is not limited to the combination of the restraint target member 33 and the restraining member 34. The fixing device may include a mechanism configured to be electrically opened and closed or a mechanism configured to electrically lock the auxiliary cylinder. The fixing device, alternatively, may include a fixing pin and a hydraulic cylinder for driving the fixing pin, as described in Patent Document 1.

The derricking member according to the present invention is not limited to the mast 15. The derricking member may be, for example, the boom 14. Specifically, the auxiliary cylinder 31 may be attached to the boom 14 so as to be capable of swing motion.

Although the fixing-state-angle difference is 0, that is, the mast angle and the auxiliary-cylinder angle coincide with each other in a state where the auxiliary cylinder 31 is fixed to the mast 15 which is a derricking member in the above embodiment, the fixing-state-angle difference is not limited to 0. In short, the mast angle and the auxiliary-cylinder angle may be different from each other in a state where the auxiliary cylinder 31 is fixed to the mast 15 which is a derricking member. Also in this case, the coincidence of the fixing-state-angle difference with the detected-angle difference allows the auxiliary cylinder to be regarded as being fixed to the derricking member. Besides, the coincidence of the fixing-state-angle difference with the detected-angle difference does not have to be rigid; the condition for judging the coincidence to the extent may be so relaxed as to accept the deviation due to the error of the deviation or the installation position of each member due to the gap set in advance.

As described above, provided are an auxiliary cylinder apparatus capable of preventing an auxiliary cylinder from undesirable swing motion to a derricking member, a working machine including the same, and a method of using the auxiliary cylinder.

The provided auxiliary cylinder apparatus is installed in a work machine including a derricking member capable of making a derricking motion of rotationally moving in a derricking direction. The apparatus includes an auxiliary cylinder, a fixing device, an auxiliary-cylinder angle detector, and an expansion controller. The auxiliary cylinder is attached to the derricking member so as to be capable of making a swing motion about an axis parallel to a rotation axis of the derricking motion to the derricking member, the auxiliary cylinder being capable of making expansion and contraction motions of expanding and contracting in expansion and contraction directions, which intersect a swing axis of the swing motion. The fixing device is configured to be capable of fixing the auxiliary cylinder to the derricking member only when an expansion length which is a length of the auxiliary cylinder in the expansion and contraction directions is within a predetermined fixing allowing range, and configured to release fixing of the auxiliary cylinder when the expansion length is deviated from the fixing allowing range. The auxiliary-cylinder angle detector detects an auxiliary-cylinder angle, which is an angle of the expansion and contraction directions of the auxiliary cylinder to a horizontal direction. The expansion controller performs an expansion control which is a control of the expansion and contraction motions of the auxiliary cylinder. The expansion control includes: judging whether the auxiliary cylinder is in a predetermined vertical posture, based on the auxiliary-cylinder angle detected by the auxiliary-cylinder angle detector; allowing the auxiliary cylinder to make the expansion and contraction motions when the auxiliary cylinder is in the vertical posture; and prohibiting the auxiliary cylinder from the expansion and contraction motions that deviates the expansion length from the fixing allowing range, when the auxiliary cylinder is in a posture other than the vertical posture in a state where the auxiliary cylinder is fixed to the derricking member by the fixing device.

This apparatus can prevent the auxiliary cylinder from undesirable rotational movement, by utilization of the expansion and contraction motions of the auxiliary cylinder. Specifically, the expansion controller of the apparatus, which prohibits the expansion and contraction motions when the auxiliary cylinder is in a posture other than the vertical posture in a state of being fixed to the derricking member by the fixing device, can prevent the auxiliary cylinder from being rotationally moved in the direction of leaving the derricking member by release of the fixing of the auxiliary cylinder to the derricking member. Besides, the expansion controller allows the auxiliary cylinder to make expansion and contraction motions in a state where the auxiliary cylinder is in the vertical posture, that is, a state where there is no risk of the rotational movement of the auxiliary cylinder, to thereby render the auxiliary cylinder available.

It is preferable that the auxiliary cylinder apparatus further includes a derricking-member angle detector that detects a derricking-member angle, which is an angle of a longitudinal direction of the derricking member to the horizontal direction, and the expansion control performed by the expansion controller further includes: prohibiting the auxiliary cylinder from the expansion and contraction motions when a detected-angle difference coincides with a fixing-state-angle difference and the auxiliary cylinder is not in the vertical posture; and allowing the auxiliary cylinder to make the expansion and contraction motions when the detected-angle difference is not coincident with the fixing-state-angle difference, even when the auxiliary cylinder is in a posture other than the vertical posture. The detected angle difference is a difference between the auxiliary-cylinder angle detected by the auxiliary-cylinder angle detector and the derricking-member angle detected by the auxiliary-cylinder angle detector, and the fixing-state-angle difference is a difference between the auxiliary-cylinder angle and the derricking-member angle when the auxiliary cylinder is fixed to the derricking member by the fixing device. The combination of the derricking-member angle detector and the expansion controller enables it to be judged whether the auxiliary cylinder is fixed to the derricking member, on the basis of the comparison between the detected-angle difference and the fixing-state-angle difference. Furthermore, allowing the expansion and contraction motions when the detected angle difference is not coincident with the fixing-state-angle difference even when the auxiliary cylinder is in a posture other than the vertical posture increases the degree of freedom of use of the auxiliary cylinder. In short, can be prevented unnecessary restriction of the expansion and contraction motions of the auxiliary cylinder in a used state where the auxiliary cylinder is not fixed to the derricking member.

In the case where the auxiliary cylinder is provided on a front side of a belly surface of the derricking member and the fixing device is configured to fix the auxiliary cylinder to the belly surface, it is preferable that the expansion and contraction control performed by the expansion and contraction controller further includes judging whether or not the derricking member is in a specific tilt posture, which is a tilt posture where the belly surface faces upward, based on the derricking-member angle detected by the derricking-member angle detector, and prohibiting the auxiliary cylinder from the expansion and contraction motions when the derricking member is in the specific tilt posture. This prevents the fixing of the auxiliary cylinder to the derricking member from being released by the expansion and contraction motions of the auxiliary cylinder in a state where the derricking member is in the specific tilt posture, thereby preventing the auxiliary cylinder from being rotationally moved in a direction of leaving the derricking member by the rotational movement of the derricking member from the specific tilt posture in a rising direction with the release of the fixing.

The work machine to be provided includes a derricking member capable of making a derricking motion of rotationally moving in a derricking direction, and the above-described auxiliary cylinder apparatus.

The method to be provided is a method for using an auxiliary cylinder which is attached to a derricking member of a work machine, the derricking member being capable of making a derricking motion of rotationally moving in a derricking direction, so as to be capable of swing motion about a swing axis parallel to a center axis of the rotational movement in the derricking direction, the auxiliary cylinder being capable of making expansion and contraction motions of expanding and contracting in expansion and contraction directions that are orthogonal to the swing axis. The method includes: installing a fixing device in the work machine, the fixing device being configured to be capable of fixing the auxiliary cylinder to the derricking member only when an expansion length, which is a length of the auxiliary cylinder in the expansion and contraction directions, is within a preset fixing allowing range and configured to release fixing of the auxiliary cylinder when the expansion length is deviated from the fixing allowing range; detecting an auxiliary-cylinder angle, which is an angle of the expansion and contraction directions of the auxiliary cylinder to the horizontal direction; judging whether or not the auxiliary cylinder is in a predetermined vertical posture, based on the detected auxiliary-cylinder angle; and performing an expansion control, which is a control of the expansion and contraction motions of the auxiliary cylinder. The expansion control includes: switching between a fixing state where the auxiliary cylinder is fixed to the derricking member by the fixing device and a fixing release state where fixing of the auxiliary cylinder by the fixing device is released, by causing the auxiliary cylinder to make the expansion and contraction motions when the auxiliary cylinder is in the vertical posture; and prohibiting the auxiliary cylinder from the expansion and contraction motions that deviates the expansion length from the fixing allowing range, when the auxiliary cylinder is in a posture other than the vertical posture in a state where the auxiliary cylinder is fixed to the derricking member by the fixing device.

Also in the method, it is preferable that the expansion control further includes: prohibiting the auxiliary cylinder from the expansion and contraction motions when the detected-angle difference coincides with the fixing-state-angle difference and the auxiliary cylinder is not in the vertical posture; and allowing the auxiliary cylinder to make the expansion and contraction motions when the detected-angle difference is not coincident with the fixing-state-angle difference, even when the auxiliary cylinder is in the posture other than the vertical posture.

Besides, also in the method, in the case where the auxiliary cylinder is provided on a front side of the belly surface of the derricking member and the fixing device is configured to fix the auxiliary cylinder to the belly surface, it is preferable that the expansion control further includes: judging whether or not the derricking member is in a specific tilt posture, which is a tilt posture in which the belly surface faces upward, based on the detected angle of the derricking member; and prohibiting the auxiliary cylinder from the expansion and contraction motions when the derricking member is in the specific tilt posture.

This application is based on Japanese Patent application No. 2020-098541 filed in Japan Patent Office on Jun. 5, 2020, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An auxiliary cylinder apparatus installed in a work machine including a derricking member capable of making a derricking motion rotating in a derricking direction, comprising:

an auxiliary cylinder attached to the derricking member so as to be capable of making a swing motion about an axis parallel to a rotation axis of the derricking motion to the derricking member, the auxiliary cylinder being capable of making expansion and contraction motions of expanding and contracting in expansion and contraction directions that intersect a swing axis of the swing motion;

a fixing device configured to be capable of fixing the auxiliary cylinder to the derricking member only when an expansion length which is a length of the auxiliary cylinder in the expansion and contraction directions is within a predetermined fixing allowing range and configured to release fixing of the auxiliary cylinder when the expansion length is deviated from the fixing allowing range;

an auxiliary-cylinder angle detector that detects an auxiliary-cylinder angle which is an angle of the expansion and contraction directions of the auxiliary cylinder to the horizontal direction; and an expansion controller that performs an expansion control which is a control of the expansion and contraction motions of the auxiliary cylinder, the expansion control including judging whether the auxiliary cylinder is in a predetermined vertical posture, based on the auxiliary-cylinder angle detected by the auxiliary-cylinder angle detector, allowing the auxiliary cylinder to make the expansion and contraction motions when the auxiliary cylinder is in the vertical posture, and prohibiting the auxiliary cylinder from the expansion and contraction motions that deviates the expansion length from the fixing allowing range, when the auxiliary cylinder is in a posture other than the vertical posture in a state where the auxiliary cylinder is fixed to the derricking member by the fixing device.

2. The auxiliary cylinder apparatus according to claim 1, further comprising: a derricking-member angle detector that detects a derricking-member angle which is an angle of a longitudinal direction of the derricking member to the horizontal direction, wherein the expansion control performed by the expansion controller further includes prohibiting the auxiliary cylinder from the expansion and contraction motions when a detected-angle difference coincides with a fixing-state-angle difference and the auxiliary cylinder is not in the vertical posture, and allowing the auxiliary cylinder to make the expansion and contraction motions when the detected-angle difference is not coincident with the fixing-state-angle difference, even when the auxiliary cylinder is in a posture other than the vertical posture, the detected angle difference being a difference between the auxiliary-cylinder angle detected by the auxiliary-cylinder angle detector and the derricking-member angle detected by the auxiliary-cylinder angle detector, and the fixing-state-angle difference being a difference between the auxiliary-cylinder angle and the derricking-member angle when the auxiliary cylinder is fixed to the derricking member by the fixing device.

3. The auxiliary cylinder apparatus according to claim 2, wherein:

the auxiliary cylinder is provided on a front side of a belly surface of the derricking member;

the fixing device is configured to fix the auxiliary cylinder to the belly surface; and the expansion control performed by the expansion controller further includes judging whether or not the derricking member is in a specific tilt posture, which is a tilt posture where the belly surface faces upward, based on the derricking-member angle detected by the derricking-member angle detector, and prohibiting the auxiliary cylinder from the expansion and contraction motions when the derricking member is in the specific tilt posture.

4. A work machine comprising:

a derricking member capable of making a derricking motion of rotationally moving in a derricking direction; and an auxiliary cylinder apparatus according to claim 1.

5. A method for using an auxiliary cylinder which is attached to a derricking member of a work machine, the derricking member being capable of making a derricking motion of rotationally moving in a derricking direction, so as to be capable of swing motion about a swing axis parallel to a center axis of the rotational movement in the derricking direction, the auxiliary cylinder being capable of making expansion and contraction motions of expanding and contracting in expansion and contraction directions that are orthogonal to the swing axis, the method comprising:

installing a fixing device in the work machine, the fixing device being configured to be capable of fixing the auxiliary cylinder to the derricking member only when an expansion length, which is a length of the auxiliary cylinder in the expansion and contraction directions, is within a preset fixing allowing range and configured to release fixing of the auxiliary cylinder when the expansion length is deviated from the fixing allowing range;

detecting an auxiliary-cylinder angle, which is an angle of the expansion and contraction directions of the auxiliary cylinder to the horizontal direction;

judging whether or not the auxiliary cylinder is in a predetermined vertical posture, based on the detected auxiliary-cylinder angle; and performing an expansion control, which is a control of the expansion and contraction motions of the auxiliary cylinder, the expansion control including switching between a fixing state where the auxiliary cylinder is fixed to the derricking member by the fixing device and a fixing release state where fixing of the auxiliary cylinder by the fixing device is released, by causing the auxiliary cylinder to make the expansion and contraction motions when the auxiliary cylinder is in the vertical posture, and prohibiting the auxiliary cylinder from the expansion and contraction motions that deviates the expansion length from the fixing allowing range, when the auxiliary cylinder is in a posture other than the vertical posture in a state where the auxiliary cylinder is fixed to the derricking member by the fixing device.

6. The method for using an auxiliary cylinder according to claim 5, further comprising detecting a derricking-member angle, which is an angle of a longitudinal direction of the derricking member to the horizontal direction, wherein the expansion control further includes: prohibiting the auxiliary cylinder from the expansion and contraction motions when a detected-angle difference coincides with a fixing-state-angle difference and the auxiliary cylinder is not in the vertical posture; and allowing the auxiliary cylinder to make the expansion and contraction motions when the detected-angle difference is not coincident with the fixing-state-angle difference, even when the auxiliary cylinder is in a posture other than the vertical posture, the detected angle difference being a difference between the auxiliary-cylinder angle detected by the auxiliary-cylinder angle detector and the derricking-member angle detected by the auxiliary-cylinder angle detector, and the fixing-state-angle difference being a difference between the auxiliary-cylinder angle and the derricking-member angle when the auxiliary cylinder is fixed to the derricking member by the fixing device.

7. The method for using an auxiliary cylinder according to claim 6, wherein:

the auxiliary cylinder is provided on a front side of a belly surface of the derricking member;

the fixing device is configured to fix the auxiliary cylinder to the belly surface; and the expansion control further includes judging whether or not the derricking member is in a specific tilt posture, which is a tilt posture in which the belly surface faces upward, based on the detected derricking-member angle, and prohibiting the auxiliary cylinder from the expansion and contraction motions when the derricking member is in the tilt posture.

* * * * *